United States Patent [19]

Yagihara et al.

[11] 4,345,025

[45] * Aug. 17, 1982

[54] COLOR PHOTOGRAPHIC SILVER HALIDE LIGHT-SENSITIVE MATERIAL

[75] Inventors: Morio Yagihara; Yukio Yokota, both of Minami-ashigara, Japan

[73] Assignee: Fuji Photo Film Co., Ltd., Kanagawa, Japan

[ * ] Notice: The portion of the term of this patent subsequent to Oct. 13, 1998, has been disclaimed.

[21] Appl. No.: 242,760

[22] Filed: Mar. 11, 1981

[30] Foreign Application Priority Data

Mar. 12, 1980 [JP] Japan ..... 55-31321

[51] Int. Cl.[3] ..... G03C 7/00; G03C 1/40

[52] U.S. Cl. ..... 430/385; 430/472; 430/473; 430/505; 430/553; 430/558

[58] Field of Search ..... 430/385, 472, 473, 505, 430/553, 558

[56] References Cited

U.S. PATENT DOCUMENTS

| | | | |
|---|---|---|---|
| 3,622,388 | 11/1971 | Pollet et al. | 430/553 |
| 4,120,723 | 10/1978 | Hara et al. | 430/385 |
| 4,228,233 | 10/1980 | Yagihara et al. | 430/553 |
| 4,254,212 | 3/1981 | Yagihara et al. | 430/553 |
| 4,294,918 | 10/1981 | Yagihara et al. | 430/553 |

*Primary Examiner*—J. Travis Brown

*Attorney, Agent, or Firm*—Sughrue, Mion, Zinn, Macpeak & Seas

[57] ABSTRACT

A color photographic silver halide light-sensitive material containing a colorless photographic cyan color-forming coupler having, in a position for coupling with the oxidation product of an aromatic primary amine developing agent, a coupling-off group represented by the following general formula (I):

$$-O-R-SO-R_1 \qquad (I)$$

wherein R represents a substituted straight or branched chain alkylene group or a substituted straight or branched chain alkenylene group; $R_1$ represents a substituted or unsubstituted straight or branched chain alkyl group, a straight or branched chain alkenyl group, a straight or branched chain aralkyl group, a straight or branched chain aralkenyl group, a cycloalkyl group, an aryl group or a heterocyclic group, and R and $R_1$ may be bonded to each other directly or through a connecting group to form a ring. The 2-equivalent photographic cyan couplers have high coupling speed and excellent dispersibility.

28 Claims, No Drawings

COLOR PHOTOGRAPHIC SILVER HALIDE LIGHT-SENSITIVE MATERIAL

FIELD OF THE INVENTION

The present invention relates to a photographic color coupler and particularly to a novel 2-equivalent cyan coupler, to a color photographic light-sensitive material containing such a photographic coupler, and to a method of forming images using such a photographic coupler.

BACKGROUND OF THE INVENTION

As is well known in the art, color images can be formed by imagewise exposure of a silver halide photographic light-sensitive material followed by color development whereby the oxidation product of the aromatic primary amine developing agent reacts with a dye-forming coupler.

Generally speaking, this color image forming method is based on the subtractive color reproduction principle, with cyan, magenta and yellow color images, each of which is in a complementary relationship to red, green and blue light, respectively, being produced. For example, cyan dye images are generally produced from couplers comprising phenol or naphthol derivatives. In the color photographic method, a color forming coupler is added to a developer solution or incorporated in a light-sensitive photographic emulsion layer or other color image-forming layer and reacts with the oxidation product of a color developing agent which is formed upon development to provide a non-diffusible dye. The reaction between the coupler and the color developing agent takes place at the active site(s) of the coupler. One mol of a so-called "4-equivalent coupler", in which all of the active sites are substituted with hydrogen, theoretically requires, on a stoichiometric basis, 4 mols of silver halide having developing nuclei as an oxidizing agent to form 1 mol of a dye.

On the other hand, 2-equivalent couplers are also known, having substituents releasable as anions at the active sites which require only 2 mols of silver halide having developing nuclei. Accordingly, by the use of 2-equivalent couplers, the amount of silver halide in the light-sensitive layer can be generally reduced and, hence, the coating thickness thereof can be reduced. This, in turn, enables the processing time of the light-sensitive material to be decreased and simultaneously results in the sharpness of the resulting color images being advantageously improved.

A variety of such coupling releasable groups are known including, for example, the sulfonamido groups set forth in U.S. Pat. No. 3,737,316, the imide groups set forth in U.S. Pat. No. 3,749,735, the sulfonyl groups set forth in U.S. Pat. No. 3,622,328, the aryloxy groups set forth in U.S. Pat. No. 3,476,563, the acyloxy groups set forth in U.S. Pat. No. 3,311,476, the thiocyano groups set forth in U.S. Pat. No. 3,214,437, the isothiocyanate groups set forth in U.S. Pat. No. 4,032,345, the sulfonyloxy groups set forth in U.S. Pat. No. 4,046,573, the thiocarbonyloxy groups set forth in Japanese Patent Application (OPI) No. 51939/77 (the term "OPI" as used herein refers to a "published unexamined Japanese patent application"), the aralkenylcarbonyloxy groups set forth in Japanese Patent Application (OPI) Nos. 39126/78 and 39745/78, the S-substituted monothiocarbonyloxy groups set forth in Japanese Patent Application (OPI) No. 45524/78, the propioroyloxy groups set forth in Japanese Patent Application (OPI) No. 47827/78, the

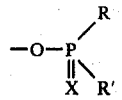

groups set forth in U.S. Pat. No. 4,072,525, and the substituted alkoxy groups set forth in U.S. Pat. Nos. 3,227,551 and 4,052,212, Japanese Patent Application (OPI) Nos. 120334/75, 18315/77, 90932/77, 52423/78, 99938/78, 10522/78, 14736/79, 48237/79 and 66129/79.

Further, if the coupler contains a suitable type of coupling releasable group, for example, one which forms a diffusible dye structure, such a coupler, referred to as a diffusible dye-releasing coupler, can be employed in a diffusion transfer process in which the released dye is used to provide a dye image in an image-receiving layer. Diffusible dye-releasing couplers are described in, for example, U.S. Pat. Nos. 3,227,550, 3,765,886, U.S. Defensive Publication T900,029, British Pat. No. 1,330,524, etc. In addition, certain 2-equivalent colored couplers exhibit a masking effect to correct undesirable absorptions of dyes and such couplers are called colored couplers as described in, for example, Japanese Patent Application (OPI) No. 26034/76.

Furthermore, 2-equivalent couplers releasing a compound having a development suppressing effect, which are referred to as development inhibitor-releasing couplers, are also known. Since these couplers can suppress or inhibit development in proportion to the amount of the developed silver, these couplers are quite effective in reducing the image-forming particle size, gradation control, and improving color reproduction characteristics. These couplers can also be used in a diffusion transfer process to affect a layer adjacent to the layer in which they are present. Examples of these couplers are described in U.S. Pat. No. 3,227,554, Japanese Patent Application (OPI) No. 122335/74 and West German Patent Application (OLS) No. 2,414,006.

Since 2-equivalent couplers generally have certain advantages and a wider range of applications as compared with 4-equivalent couplers, the photographic industry tends to use 2-equivalent couplers more frequently.

However, most known 2-equivalent cyan color-forming couplers have certain disadvantages, in that the coupling reactivity is insufficient, color fog is formed, the dispersibility thereof is poor which causes difficulties during coating, the compound per se is unstable and cannot be stored for a long time, and the storage stability of the resulting color image formed by color development is poor. Thus improvements to overcome these disadvantages have been desired.

SUMMARY OF THE INVENTION

An object of the present invention is, therefore, to provide novel 2-equivalent cyan-forming couplers which overcome the defects described above and which have an excellent dispersibility and color-forming properties.

Another object of the present invention is to provide novel 2-equivalent cyan-forming couplers having high coupling speed.

Still another object of the present invention is to provide a method for forming a cyan color image by developing a silver halide emulsion in the presence of a novel 2-equivalent coupler.

A further object of the present invention is to provide a silver halide color photographic light-sensitive material containing a novel 2-equivalent coupler and a method of photographic processing or a method for forming images using that light-sensitive material.

As a result of various investigations, it has now been discovered that the above-described objects can effectively be attained using a colorless photographic cyan color-forming coupler having at the coupling position, at which the coupler reacts with the oxidation product of an aromatic primary amine developing agent, a coupling-off group represented by the following general formula (I):

$$—O—R—SO—R_1 \quad (I)$$

wherein R represents a substituted alkylene group or a substituted alkylene group and said alkylene group and alkenylene group may be straight or branched chain; $R_1$ represents a substituted or unsubstituted alkyl group, an alkenyl group, an aralkyl group, an aralkenyl group, a cycloalkyl group, an aryl group or a heterocyclic group and said alkyl group, alkenyl group, aralkyl group and aralkenyl group may be straight or branched chain; and R and $R_1$ may be bonded to each other directly or through a connecting group to form a ring.

DETAILED DESCRIPTION OF THE INVENTION

The group represented by formula (I) above splits off when a cyan dye is formed by the coupling reaction.

The term "colorless" couplers as used herein means those couplers whose molecular extinction coefficient does not exceed 5,000 at its absorption maximum wavelength within the visible light region.

The colorless 2-equivalent cyan color-forming couplers of the present invention show a faster dye-forming rate as compared with conventional couplers having an alkoxy group at the active position, and hence they provide higher sensitivity, higher gradation, and higher maximum density. Thus, they are suitable not only for ordinary processing, but also for rapid processing as well. Further, they do not cause fogging, color stain, etc., of a light-sensitive layer, and they show such good dispersibility in photographic layers such as a light-sensitive layer that they can be dispersed therein in a high concentration. Dyes to be obtained from such cyan couplers show excellent durability against light, heat, and humidity and show such good light absorption characteristics that they do not have unnecessary absorptions and that they show sharp absorptions. In addition, they have the advantage that they are useful for forming images in a so-called conventional system.

Preferred couplers of this invention are couplers represented by the following general formula (IA):

$$A—O—R—SO—R_1)_n \quad (IA)$$

where A represents a cyan color-forming coupler residue having a naphtholic or phenolic nucleus; R represents a substituted alkylene group having 1 to 18 carbon atoms (examples of the alkylene group being, for example, a methylene group, a dimethylene group, a trimethylene group, a 2-methyldimethylene group, a 2-methyltrimethylene group, a tetramethylene group, an octamethylene group or a dodecamethylene group, etc.) or a substituted alkenylene group having 2 to 18 carbon atoms (examples of the alkenylene group being, for example, a 2-butenylene group, etc.). These alkylene groups and alkenylene groups may be straight or branched chain.

Suitable substituents for the alkylene group and the alkenylene group include an aryl group (for example, a phenyl group, a naphthyl group, etc.), a nitro group, a hydroxy group, a cyano group, a sulfo group, an alkoxy group (for example, a methoxy group, an ethoxy group, a methoxyethoxy group, etc.), an aryloxy group (for example, a phenoxy group, etc.), an acyloxy group (for example, an acetoxy group, a benzoyloxy group, etc.), an acylamino group (for example, an acetylamino group, a benzoylamino group, etc.), a sulfonamido group (for example, a methanesulfonamido group, a phenylsulfonamido group, etc.), a sulfamoyl group (for example, a methylsulfamoyl group, a phenylsulfamoyl group, etc.), a halogen atom (for example, a fluorine atom, a chlorine atom, a bromine atom, etc.), a carboxy group, a carbamoyl group (for example, a methylcarbamoyl group, a phenylcarbamoyl group, etc.), an alkoxycarbonyl group (for example, a methoxycarbonyl group, an ethoxycarbonyl group, etc.), an acyl group (for example, an acetyl group, a benzoyl group, etc.), a sulfonyl group (for example, a methylsulfonyl group, a phenylsulfonyl group, etc.), a heterocyclic group (for example, a morpholino group, a pyrazolyl group, a triazolyl group, etc.), an amino group (for example, an unsubstituted amino group, an ethylamino group, etc.), or a sulfinyl group represented by the formula $—SO—R_1$. When two or more substituents are present, they may be the same or different.

$R_1$ represents an alkyl group containing 1 to 18 carbon atoms (for example, a methyl group, an ethyl group, an n-propyl group, an isopropyl group, an n-butyl group, an isobutyl group, a tert-butyl group, an n-hexyl group, an n-octyl group, an n-dodecyl group, an n-octadecyl group, etc.), an alkenyl group containing 2 to 18 carbon atoms (for example, a propenyl group, a butenyl group, an octenyl group, an n-octadecenyl group, etc.), an aralkyl group containing 7 to 18 carbon atoms (for example, a benzyl group, a phenethyl group, etc.), an aralkenyl group containing 8 to 18 carbon atoms (for example, a phenylpropenyl group, etc.), a cycloalkyl group (for example, a cyclopentyl group, a cyclohexyl group, a methylcyclohexyl group, a cycloheptyl group, etc.), an aryl group containing 6 to 12 carbon atoms (for example, a phenyl group, a naphthyl group, etc.) or a 5-membered or 6-membered heterocyclic group in which, for example, the hetero ring may contain one nitrogen atom and further an oxygen atom, a sulfur atom and/or a nitrogen atom (for example, an imidazolyl group, a pyrazolyl group, a triazolyl group, a tetrazolyl group, a thiazolyl group, a piperazyl group, etc.).

Each of the alkyl group, alkenyl group, aralkyl group, aralkenyl group, cycloalkyl group, aryl group and heterocyclic group represented by $R_1$ may be substituted with a substituent, for example, a halogen atom (fluorine, chlorine, or bromine), a cyano group, a hydroxy group, an alkoxy group (for example, a methoxy group, an ethoxy group, a propyloxy group, a butoxy group, an octyloxy group, etc.), an aryloxy group (for example, a phenoxy group, etc.), an acyloxy group (for example, an acetyloxy group, a propionoyloxy group, a butyroyloxy group, a benzoyloxy group, etc.), an acylamino group (for example, a formamino group, an acetylamino group, a propionoylamino group, a benzoylamino group, etc.), a sulfonamido group (for example, a methylsulfonamido group, an octylsulfonamido group, a benzenesulfonamido group, etc.), a sulfamoyl group (for example, an unsubstituted sulfamoyl group, a methylsulfamoyl group, an ethylsulfamoyl group, a propylsulfamoyl group, a phenylsulfamoyl group, etc.), a sulfonyl group (for example, a methylsulfonyl group, an ethylsulfonyl group, an octylsulfonyl group, a benzenesulfonyl group, etc.), a carboxy group, a sulfo group, a nitro group, an arylthio group (for example, a phenylthio group, etc.), an alkylthio group (for example, a methylthio group, an ethylthio group, etc.), a carbamoyl group (for example, an ethylcarbamoyl group, a phenylcarbamoyl group, etc.), an alkoxycarbonyl group (for example, a methoxycarbonyl group, an ethoxycarbonyl group, etc.), a sulfinyl group (for example, a methylsulfinyl group, a phenylsulfinyl group, etc.) or a heterocyclic group (for example, a pyrazolyl group, a triazolyl group, etc.). These substituents may be further substituted with substituents as described above. Further, where two or more substituents are present, they may be the same or different.

Furthermore, the alkyl group, the alkenyl group, the aralkyl group and the aralkenyl group may be straight or branched chain.

Also, R and $R_1$ may be bonded together directly or through a connecting group to form a ring.

Preferred groups represented by $R_1$ in the general formula (IA) are a substituted or unsubstituted alkyl group, an alkenyl group, a cycloalkyl group and a 5-membered or 6-membered heterocyclic group.

Of the compounds represented by the general formula (IA), particularly preferred compounds are those in which R represents a straight or branched chain alkylene group having 1 to 4 carbon atoms substituted with an alkylsulfinyl group represented by —SO—$R_{11}$ (wherein $R_{11}$ has the same meaning as defined for $R_1$) or a hydroxy group in view of the effects of the present invention. Further, particularly preferred positions for substitution of the —SO—$R_1$ group are at the $\alpha$-, $\beta$- and $\gamma$-positions with respect to the alkoxy group represented by —OR in the formula (I).

Furthermore, the carboxy group and the sulfo group may form a salt together with an alkali metal atom (for example, lithium, sodium, potassium, etc.), an alkaline earth metal atom (for example, calcium, barium, etc.), or an ammonium group (for example, triethyl ammonium, pyridinium, etc.).

In the above-described general formula (IA), the cyan coupler residue is a residue of a cyan coupler from which a hydrogen atom or a coupling-off group at the active site of a cyan coupler is removed and, where a plural number of active sites exist in the same molecule, the coupling-off groups introduced at the respective active sites may be the same or different, or a hydrogen atom may be still present. Preferably, however, all active sites have the coupling-off group of the present invention.

Furthermore, n preferably represents 1 or 2, but, in the case of a polymeric cyan coupler, n may be 3 or more.

Particularly useful couplers of the invention are those represented by the formulae (IIA) or (IIB):

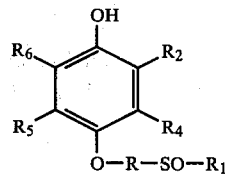

(IIA)

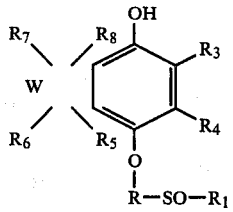

(IIB)

In the above general formulae, R and $R_1$ each has the same meaning as defined for R and $R_1$ in formula (I) above, $R_2$ represents a hydrogen atom, an aliphatic group containing up to 30 carbon atoms (for example, an alkyl group such as a methyl group, an isopropyl group, a pentadecyl group, an eicosyl group, or the like), an alkoxy group containing up to 30 carbon atoms (for example, a methoxy group, an isopropoxy group, a pentadecyloxy group, an eicosyloxy group, or the like), an aryloxy group (for example, a phenoxy group, a p-tert-butylphenoxy group, or the like), an acylamido group, a sulfonamido group, a phosphoric acid amido group, a ureido group represented by the following formulae (III) to (VI), or a carbamoyl group represented by the following formula (VII) or (VIII):

—NH—CO—B (III)

—NH—$SO_2$—B (IV)

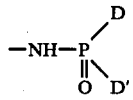

(V)

—NHCONH—B (VI)

—CONH—B (VII)

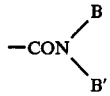

(VIII)

wherein B and B' may be the same or different and each represents an aliphatic group containing from 1 to 32 carbon atoms, and preferably a straight or branched alkyl group containing from 1 to 20 carbon atoms (for example, a methyl group, an isopropyl group, a pentadecyl group, an eicosyl group, or the like), a cyclic alkyl group (for example, a cyclopropyl group, a cyclohexyl group, a norbornyl group, or the like), or an aryl group (for example, a phenyl group, a naphthyl group, or the like). The above-described alkyl group and aryl group may be substituted with a halogen atom (for example, fluorine, chlorine, or the like), a nitro group, a cyano group, a hydroxy group, a carboxy group, an amino group (for example, an amino group, an alkylamino group, a dialkylamino group, an anilino group, an N-alkylanilino group, or the like), an alkyl group (for example, those described hereinbefore), an aryl group (for example, a phenyl group, an acetylaminophenyl group, or the like), an alkoxycarbonyl group (for example, a tetradecyloxycarbonyl group, or the like), an acyloxycarbonyl group, an amido group (for example, an acetamido group, a methanesulfonamido group, or the like), an imido group (for example, a succinimido group, or the like), a carbamoyl group (for example, an N,N-dihexylcarbamoyl group, or the like), a sulfamoyl group (for example, an N,N-diethylsulfamoyl group, or the like), an alkoxy group (for example, an ethoxy group, a tetradecyloxy group, an octadecyloxy group, or the like), an aryloxy group (for example, a phenoxy group, a p-tert-butylphenoxy group, a 2,4-diamylphenoxy group, a 4-hydroxy-3-tert-butylphenoxy group, or the like), etc.

D and D' each represents B as described above, or —OB, —NHB, or —$NB_2$.

$R_2$ may also represent a substituent conventionally used in addition to the above-described substituents.

$R_3$ is selected from a hydrogen atom, an aliphatic group containing up to 30 carbon atoms (particularly, an alkyl group containing from 1 to 20 carbon atoms), and a carbamoyl group represented by the formula (VII) or (VIII).

$R_4$, $R_5$, $R_6$, $R_7$ and $R_8$ each represents a hydrogen atom, a halogen atom, an alkyl group, an aryl group, an alkoxy group, an alkylthio group, a heterocyclic group, an amino group, a carbonamido group, a sulfonamido group, a sulfamoyl group, or a carbamyl group. For example, $R_4$ can represent one of the following groups: a halogen atom (for example, a chlorine atom, a bromine atom, or the like), a straight or branched chain alkyl group containing 1 to 22 carbon atoms (for example, a methyl group, a propyl group, an isopropyl group, an n-butyl group, a sec-butyl group, a tert-butyl group, a hexyl group, a dodecyl group, a 2-chlorobutyl group, a 2-hydroxyethyl group, a 2-phenylethyl group, a 2-(2,4,6-trichlorophenyl)ethyl group, a 2-aminoethyl group, or the like), an alkylthio group (for example, a hexadecylthio group, or the like), an aryl group (for example, a phenyl group, a 4-methylphenyl group, a 2,4,6-trichlorophenyl group, a 3,5-dibromophenyl group, a 4-trifluoromethylphenyl group, a 2-trifluoromethylphenyl group, a 3-trifluoromethylphenyl group, a naphthyl group, a 2-chloronaphthyl group, a 3-ethylnaphthyl group, or the like), a heterocyclic ring group (for example, a benzofuranyl group, a furanyl group, a thiazolyl group, a benzothiazolyl group, a naphthothiazolyl group, an oxazolyl group, a benzoxazolyl group, a naphthoxazolyl group, a pyridyl group, a quinolinyl group, or the like), an amino group (for example, an amino group, a methylamino group, a diethylamino group, a dodecylamino group, a phenylamino group, a tolylamino group, a 4-(3-sulfobenzamido)anilino group, a 4-cyanophenylamino group, a 2-trifluoromethylphenylamino group, a benzothiazolamino group, or the like), a carbonamido group [for example, an alkylcarbonamido group (e.g., an ethylcarbonamido group, a decylcarbonamido group, a phenylethylcarbonamido group, etc.); an arylcarbonamido group (e.g., a phenylcarbonamido group, a 2,4,6-trichlorophenylcarbonamido group, a 4-methylphenylcarbonamido group, a 2-ethoxyphenylcarbonamido group, a 3-[α-(2,4-di-tert-amylphenoxy)acetamido]benzamido group, a naphthylcarbonamido group, etc.); a heterocyclic carbonamido group (e.g., a thiazolylcarbonamido group, a benzothiazolylcarbonamido group, a naphthothiazolylcarbonamido group, an oxazolylcarbonamido group, a benzoxazolylcarbonamido group, an imidazolylcarbonamido group, a benzimidazolylcarbonamido group, etc.), or the like], a sulfonamido group [for example, an alkylsulfonamido group (e.g., a butylsulfonamido group, a dodecylsulfonamido group, a phenylethylsulfonamido group, etc.); an arylsulfonamido group (e.g., a phenylsulfonamido group, a 2,4,6-trichlorophenylsulfonamido group, a 2-methoxyphenylsulfonamido group, a 3-carboxyphenylsulfonamido group, a naphthylsulfonamido group, etc.); or a heterocyclic sulfonamido group (e.g., a thiazolylsulfonamido group, a benzothiazolylsulfonamido group, an imidazolylsulfonamido group, a benzimidazolylsulfonamido group, a pyridylsulfonamido group, etc.); or the like], a sulfamyl group [for example, an alkylsulfamyl group (e.g., a propylsulfamyl group, an octylsulfamyl group, a pentadecylsulfamyl group, an octadecylsulfamyl group, etc.); an arylsulfamyl group (e.g., a phenylsulfamyl group, a 2,4,6-trichlorophenylsulfamyl group, a 2-methoxyphenylsulfamyl group, a naphthylsulfamyl group, etc.); a heterocyclic sulfamyl group (e.g., a thiazolylsulfamyl group, a benzothiazolylsulfamyl group, an oxazolylsulfamyl group, a benzimidazolylsulfamyl group, a pyridylsulfamyl group, etc.); or the like], and a carbamyl group [for example, an alkylcarbamyl group (e.g., an ethylcarbamyl group, an octylcarbamyl group, a pentadecylcarbamyl group, an octadecylcarbamyl group, etc.); an arylcarbamyl group (e.g., a phenylcarbamyl group, a 2,4,6-trichlorophenylcarbamyl group, etc.); a heterocyclic carbamyl group (e.g., a thiazolylcarbamyl group, a benzothiazolylcarbamyl group, an oxazolylcarbamyl group, an imidazolylcarbamyl group, a benzimidazolylcarbamyl group, etc.); or the like]. As the examples of $R_5$, $R_6$, $R_7$ and $R_8$, those illustrated for $R_4$ can be used.

W represents non-metallic atoms necessary to form a 5- or 6-membered ring, such as a benzene ring, a cyclohexane ring, a cyclopentene ring, a thiazole ring, an oxazole ring, an imidazole ring, a pyridine ring, a pyrrole ring, etc., with a benzene ring being preferred.

Specific examples of typical coupling-off groups of the 2-equivalent cyan couplers according to the invention are illustrated below.

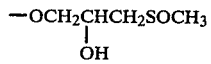

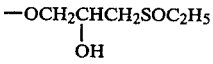

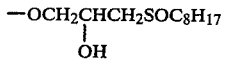

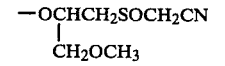

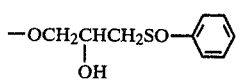

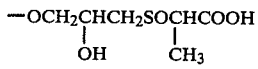

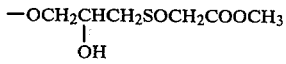

-continued $-OCH_2CH(OH)CH_2SOCH_2CH_2SO_3K$ $-OCH_2CH(OH)CH_2SOCH_2CH(OH)CH_3$ $-OCH_2CH(OH)CH_2SO-$ 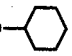

$-OCH(CH_2SOCH_2CH_2OH)CH_2SOCH_2CH_2OH$ $-OCH_2CH(COOC_2H_5)SOCH_2CH_2OH$ $-OCH_2CH(Br)CH(CH_3)SOCH_2COOH$ $-OCH_2CH(OH)CH_2SOCH_2CH(OH)CH_2OH$ $-OCH_2CH(OH)CH_2SO-$ 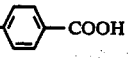 $-COOH$ $-OCH_2CH(OH)CH_2SO-$ 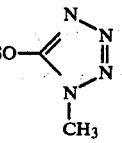

$-OCH_2CH(OH)CH_2SOCH(C_{12}H_{25})COOH$ $-OCH_2CH(OH)CH_2SOCH_2CH=CH_2$ $-OCH_2CH(COOH)SOCH_2CH_2OH$ $-OCH_2CH(OH)CH_2SOCH_2COOH$ $-OCH_2CH(Cl)CH_2SOCH_2COOH$ $-OCH_2CH(O-$ 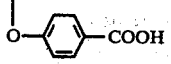 $-COOH)CH_2SOCH_2COOH$ $-OCH_2CH(SOCH_3)CH_2SOCH_3$ $-OCH_2CH(SO-$ 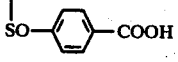 $-COOH)CH_2SO-$ 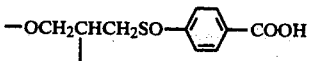 $-COOH$ -continued $-OCH_2CH(SO-$ 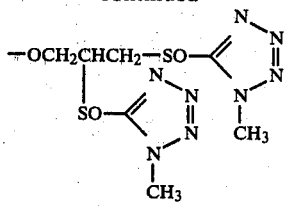

$-OCH_2CH(SOCH_2CH_2OH)CH_2SOCH_2CH_2OH$ $-OCH_2CH(SOCH_2COOH)CH(CH_3)SOCH_2COOH$ $-OCH_2CH(OH)CH_2SOCH_2CH(OH)CH_2OH$ $SOCH_2CH(OH)CH_2OH$ $-OCH_2CH(SOCH_2COOH)CH_2SOCH_2COOH$ $-OCH(CH_2SOCH_2COOH)CH_2SOCH_2COOH$ $-OCH_2CH(SOCH_2CH_2COOH)CH_2SOCH_2CH_2COOH$ $-OCH_2CH(SOCHCOOH)CH_2SOCH(CH_3)COOH$ $-OCH_2CH(SOCH_2CONH_2)CH_2SOCH_2CONH_2$ $-OCH_2CH(SOCHCOOH)CH_2SOCH(C_{12}H_{25})COOH$ $-OCH_2CH(SOCH_2CH_2SO_3K)CH_2SOCH_2CH_2SO_3K$ $-OCH_2CH(SOCH_2COOK)CH_2SOCH_2COOK$

Specific examples of typical 2-equivalent cyan couplers according to the present invention are set forth below, but the present invention is not to be construed as being limited thereto.

Coupler (1)

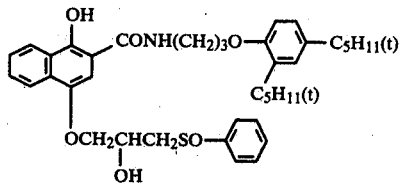

-continued
Coupler (2)
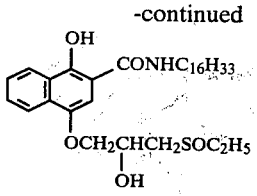
Coupler (3)
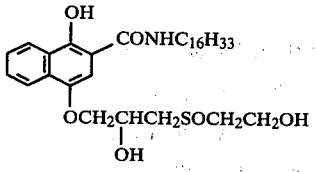
Coupler (4)
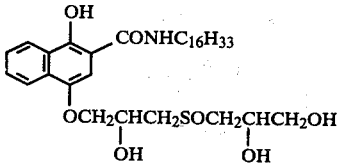
Coupler (5)
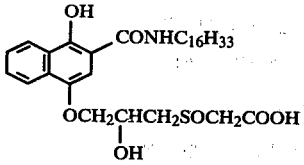
Coupler (6)
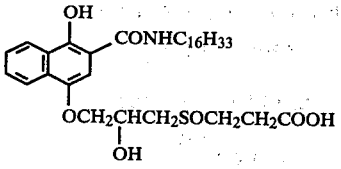
Coupler (7)
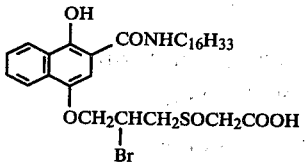
Coupler (8)
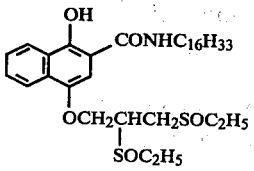
Coupler (9)
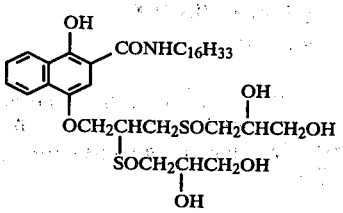
Coupler (10)
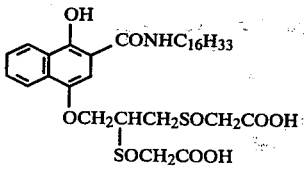
-continued
Coupler (11)
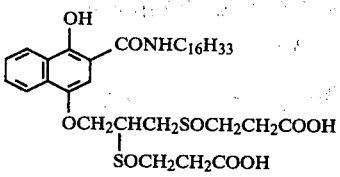
Coupler (12)
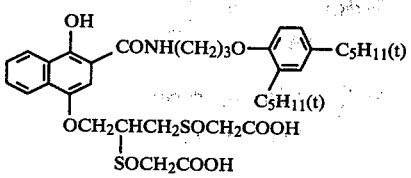
Coupler (13)
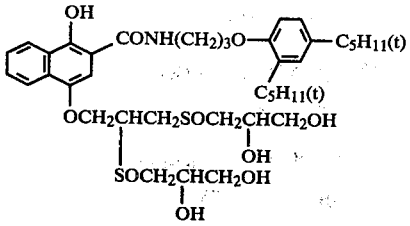
Coupler (14)
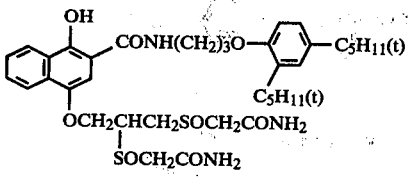
Coupler (15)
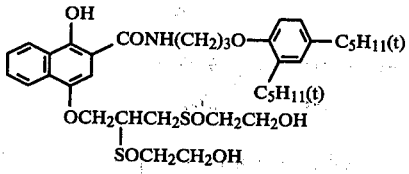
Coupler (16)
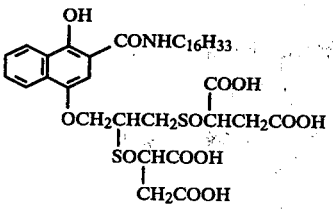
Coupler (17)
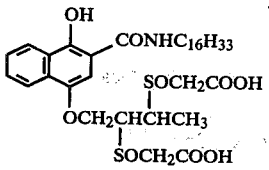
Coupler (18)
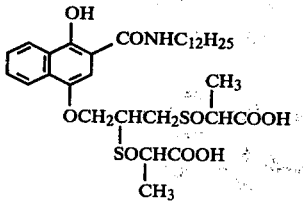

-continued
Coupler (19)
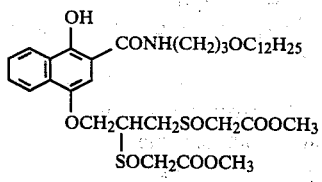
Coupler (20)
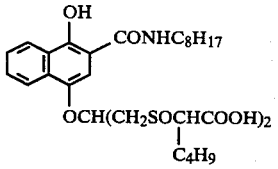
Coupler (21)
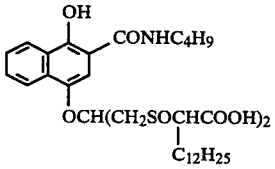
Coupler (22)
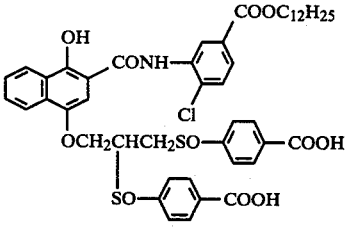
Coupler (23)
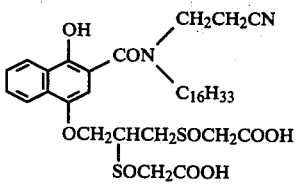
Coupler (24)
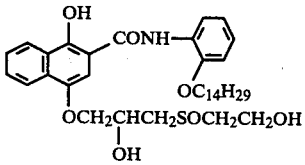
Coupler (25)
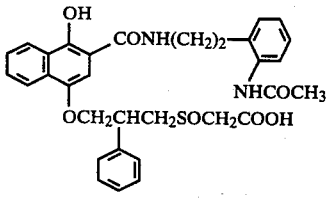
Coupler (26)
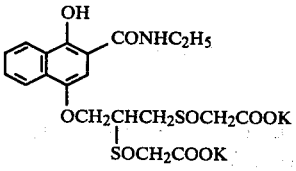
-continued
Coupler (27)
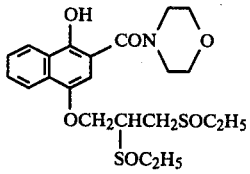
Coupler (28)
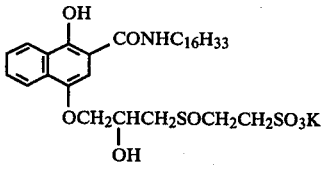
Coupler (29)
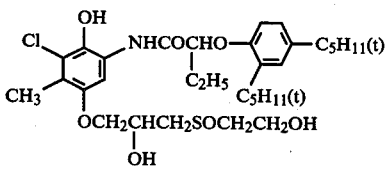
Coupler (30)
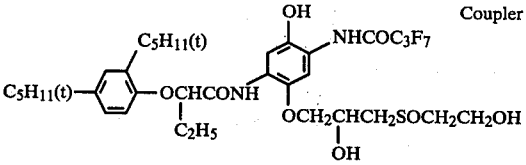
Coupler (31)
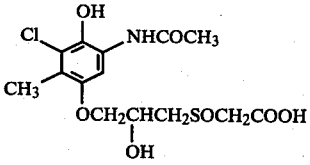
Coupler (32)
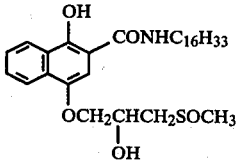
Coupler (33)
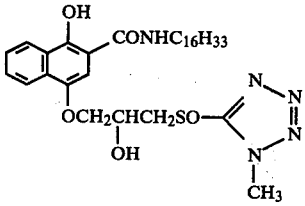
Coupler (34)
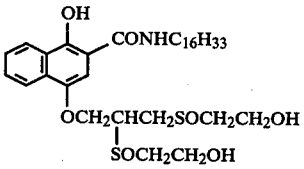
Coupler (35)
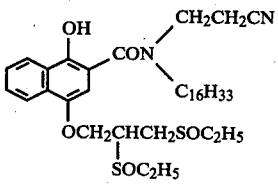

These compounds according to the present invention can be synthesized according to the following processes.

Both naphtholic and phenolic couplers can be synthesized by reacting a 1,4-dihydroxyaryl derivative represented by the following general formula (IX) or (X):

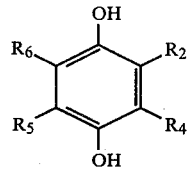
(IX)

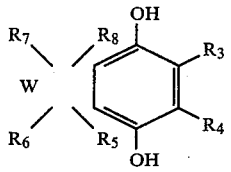
(X)

where in the above formulae, $R_2$, $R_3$, $R_4$, $R_5$, $R_6$, $R_7$, $R_8$ and W are the same as defined for the formulae (IIA) and (IIB) previously, with an appropriate alkyl halide in a solvent such as acetone, dimethylformamide, methanol, water, etc., in the presence of pyridine, sodium carbonate, sodium hydroxide, a sodium alkoxide, etc., at room temperature or under heating. Alternatively, these cyan couplers can be synthesized by reacting a 1,4-dihydroxyaryl derivative with a halogen-substituted alcohol in toluene in the presence of an acid catalyst to haloalkylate the hydroxy group at the 4-position and reacting the product obtained with a substituted alkylthiol, a substituted arylthiol or a heterocyclic thiol in an alcohol in the presence of sodium hydroxide or a sodium alkoxide, etc., at room temperature or under heating to carry out a thioetherification and then oxidizing the resulting compound with hydrogen peroxide.

Furthermore, cyan couplers can be synthesized by thioetherification of the haloalkoxy group at the 4-position obtained by the above-described haloalkylation and then oxidation with hydrogen peroxide using the following reaction:

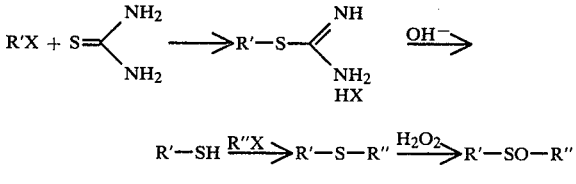

In the above reaction schematic, X represents a halogen atom.

With regard to naphtholic couplers, the corresponding couplers can be synthesized in the following manner. A 1,4-dihydroxy-2-naphthoic acid is reacted with a halogen-substituted alcohol in toluene in the presence of an acid catalyst. The resulting 1-hydroxy-4-halo-substituted alkoxy-2-naphthoic acid derivative is converted to an acid chloride or a phenyl ester derivative in a conventional manner. The acid chloride or phenyl ester derivative is then condensed with a corresponding amine such as aniline, 2,4-di-tert-amylphenoxypropylamine, etc., to prepare the above-described 4-haloalkoxy compound and the latter is subjected to thioetherification and oxidation in the same manner as described above to form the corresponding coupler.

With regard to phenolic couplers, the corresponding couplers can be synthesized as follows. The hydroxy group at the 1-position of a 1,4-dihydroxybenzene derivative is previously protected by, for example, pyranyl etherification or an oxazole ring is previously formed from the hydroxy group at the 1-position and an acetylamino group at the 2-position according to Japanese Patent Application (OPI) No. 153923/77. The resulting hydroxy-protected compound is reacted with a corresponding alkyl halide in the presence of a basic catalyst to alkylate the hydroxy group at the 4-position. The oxazole ring is then cleaved with an acid and the resulting product is reacted with a corresponding acid chloride in the presence of a dehydrochlorinating agent to form the corresponding coupler.

Typical examples of synthesizing couplers according to the present invention will specifically be described below. Unless otherwise indicated herein, all parts, percents, ratios and the like are by weight.

SYNTHESIS EXAMPLE 1

Synthesis of 1-hydroxy-4-[β-hydroxy-γ-(β'-hydroxyethylsulfinyl)-propyloxy]-N-n-hexadecyl-2-naphthamide [Coupler (3)]

22 g (0.05 mol) of 1,4-dihydroxy-N-n-hexadecyl-2-naphthamide, 11 g (0.1 mol) of 3-chloro-2-hydroxypropanol and 9 g (0.05 mol) of p-toluenesulfonic acid were added to 200 ml of dehydrated toluene. The mixture was refluxed by heating for 5 hours and the water formed was removed from the reaction system. Then toluene was distilled off under reduced pressure and methanol was added to the residue. The crystals precipitated were collected by filtration to obtain 20.3 g (0.038 mol) of 4-(γ-chloro-β-hydroxypropyloxy) derivative.

Then, 10.4 g (0.02 mol) of the thus-obtained 4-(γ-chloro-β-hydroxypropyloxy) derivative, 2.4 g (0.03 mol) of mercaptoethanol and 5.6 g (0.1 mol) of potassium hydroxide were dissolved by heating in a mixture of 100 ml of methanol and 50 ml of water under a nitrogen atmosphere. After refluxing by heating for 3 hours, 100 ml of water was added to the reaction mixture. Under cooling at 10° to 20° C., 10 ml of concentrated hydrochloric acid was added to the mixture and the crystals precipitated were collected by filtration to obtain 8.5 g (75% yield) of 1-hydroxy-4-[β-hydroxy-γ-(β'-hydroxyethtylthio)propyloxy]-N-n-hexadecyl-2-naphthamide.

5.6 g (0.01 mol) of the thus-obtained thioether derivative was dissolved in 50 ml of glacial acetic acid. To the solution, 2 g of hydrogen peroxide (35%) was added at a temperature of 30° to 40° C. The mixture was stirred for 20 minutes and then poured into 300 ml of water. The crystals precipitated were collected by filtration and recrystallized from a solvent mixture of n-hexane and ethyl acetate to obtain 4.9 g (85% yield) of Coupler (3).

Melting Point: 114° to 116° C.

Elemental Analysis for $C_{32}H_{51}NO_6S$: Calculated (%): C: 66.51 H: 8.90 N: 2.42. Found (%): C: 66.56 H: 8.62 N: 2.54.

SYNTHESIS EXAMPLE 2

Synthesis of 1-hydroxy-4-[β-hydroxy-(γ-carboxymethylsulfinyl)-propyloxy]-N-n-hexadecyl-2-naphthamide [Coupler (5)]

10.4 g (0.02 mol) of 1-hydroxy-4-(γ-chloro-β-hydroxypropyloxy)-N-n-hexadecyl-2-naphthamide obtained as described in Synthesis Example 1, 2.8 g (0.03 mol) of thioglycolic acid and 5.6 g (0.1 mol) of potassium hydroxide were dissolved by heating in a mixture of 100 ml of methanol and 50 ml of water under a nitrogen atmosphere. After refluxing by heating for 3 hours, 100 ml of water was added to the reaction mixture under cooling at 10° to 20° C., 10 ml of concentrated hydrochloric acid added to the mixture and the crystals precipitated were collected by filtration to obtain 9.7 g (84% yield) of 1-hydroxy-4-[β-hydroxy-(γ-carboxymethylthio)propyloxy]-N-n-hexadecyl-2-naphthamide.

Then, 5.7 g (0.01 mol) of the thus-obtained thioether derivative was dissolved in 50 ml of glacial acetic acid. To the solution, 2 g of hydrogen peroxide (35%) was added at a temperature of 30° to 40° C. and the mixture was stirred for 20 minutes. The mixture was poured into 300 ml of water and the crystals precipitated were collected by filtration and recrystallized from ethyl acetate to obtain 4.7 g (80% yield) of Coupler (5).

Melting Point: 124° to 126° C.

Elemental Analysis for $C_{32}H_{49}NO_7S$: Calculated (%): C: 64.94 H: 8.35 N: 2.37. Found (%): C: 64.59 H: 8.42 N: 2.35.

Formation of dye images in accordance with the present invention can be achieved with various types of light-sensitive materials. One approach is a process of forming a water-insoluble or diffusion-resistant dye image in an emulsion layer by processing a silver halide light-sensitive material with a color developer containing dissolved therein an aromatic primary amine color-developing agent and a coupler, which process is a coupler-in-developer type color photographic process. For example, illustrative Couplers (25), (26) and (27) can be used for such process. Another approach is a process of forming a water-insoluble or diffusion-resistant dye image in an emulsion layer by processing a light-sensitive material comprising a support having thereon a silver halide emulsion layer containing a diffusion-resistant coupler, with an alkaline developer containing an aromatic primary amine color-developing agent. For example, illustrative Couplers (3), (5), (32), (33), etc., can be used in this process.

The phenolic or α-naphtholic couplers used in the present invention are dissolved in an aqueous medium or an organic solvent, and then dispersed in the photographic emulsion.

Of the couplers of the invention, oil-soluble diffusion-resistant couplers used for a coupler-in-emulsion process are first dissolved in an organic solvent, then dispersed as fine colloidal particles in a photographic emulsion for incorporation into a light-sensitive material.

It is most preferred to dissolve oil-soluble diffusion-resistant couplers in an organic solvent, and add the resulting solution to a photographic emulsion, to provide the best effect according to this invention.

Oil-soluble diffusion-resistant couplers represented by the formulae (IIA) and (IIB) are those wherein one of the substituents represented by $R_1$ through $R_8$ represents a group having a ballast group containing a $C_8$ to $C_{30}$ hydrophobic residue which is bonded to the coupler skeletal structure directly or via an imino bond, an ether bond, a thioether bond, a carbonamido bond, a sulfonamido bond, a ureido bond, an ester bond, a carbonyl bond, an imido bond, a carbamoyl bond, a sulfamoyl bond, or the like.

Examples of such a ballast group include an alkyl group, an alkoxyalkyl group, an alkenyl group, an alkyl-substituted aryl group, or alkoxy-substituted aryl group, etc. These ballast groups may be substituted by a halogen atom (e.g., a fluorine atom, a chlorine atom, etc.), a nitro group, an amino group, a cyano group, an alkoxycarbonyl group, an aryloxycarbonyl group, an amino group, a carbamoyl group, a sulfamoyl group, a ureido group, a sulfonamido group, or the like. Specific examples of suitable ballast groups include a 2-ethylhexyl group, a tert-octyl group, an n-dodecyl group, a 2,2-dimethyldodecyl group, an n-octadecyl group, a 2-(n-hexyl)decyl group, a 9,10-dichlorooctadecyl group, a 2,4-di-tert-amylcyclohexyl group, a dodecyloxypropyl group, an oleyl group, a 2,4-di-tert-amylphenyl group, a 2,4-di-tert-amyl-6-chlorophenyl group, a 3-n-pentadecylphenyl group, a 2-dodecyloxyphenyl group, a 3-heptadecyloxyphenyl group, a perfluoroheptyl group, and so forth.

The amount of the coupler used is generally in the range of from about 1 to 1,500 g per mol of silver halide, which, however, can be changed according to the specific end-uses.

A specific and suitable manner for dispersing the above-described diffusion-resistant couplers in a photographic emulsion is described in detail in U.S. Pat. No. 3,676,131. An organic solvent having low solubility in water, a high boiling point, and compatible with the couplers in a color light-sensitive material such as substituted hydrocarbons, carboxylic acid esters, carboxylic acid amides, phosphoric acid esters, and ethers may be used to dissolve the couplers. Specific examples of such solvents include di-n-butyl phthalate, di-isooctyl acetate, di-n-butyl sebacate, tricresyl phosphate, tri-n-hexyl phosphate, tricyclohexyl phosphate, N,N-diethylcaprylamide, butyl-n-pentadecylphenyl ether, chlorinated paraffin, butyl benzoate, pentyl-o-methylbenzoate, propyl-2,4-dichlorobenzoate, etc. It is advantageous to use, in addition to the above-described high boiling solvents, an auxiliary solvent which helps dissolve the couplers and which can be removed during the production of light-sensitive materials. Examples of such auxiliary solvents include propylene carbonate, ethyl acetate, butyl acetate, cyclohexanol, tetrahydrofuran, cyclohexanone, etc.

The use of a surface active agent is advantageous to assist in finely dispersing these oil-soluble couplers in a hydrophilic high molecular weight material to be used in a photographic emulsion. In particular, anionic surface active agents such as sodium cetylsulfate, sodium p-dodecylbenzenesulfonate, sodium nonylnaphthalenesulfonate, sodium di(2-ethylhexyl)-α-sulfosuccinate, etc., and nonionic surface active agents such as sorbitan sesquioleic acid ester, sorbitan monolauric acid ester, etc., are suitable.

A homogenizer for an emulsion, a colloid mill, an ultrasonic wave emulsifier, and the like are useful for dispersing the oil-soluble couplers.

Examples of silver halide light-sensitive materials in which the coupler of the present invention can be used include color negative films, color positive films, color reversal films, color reversal papers, color papers and other color photographic products for general use. Further, the couplers of the present invention can be used in color direct positive products, monochromatic products, color radiographic products, and so forth.

In the production of silver halide color photographic light-sensitive materials using the couplers of the present invention, the couplers may be used alone or in combinations of two or more. Color photographic light-sensitive materials containing the coupler or couplers of the present invention may also contain other additional couplers. For example, such other couplers include the cyan dye-forming couplers as described in U.S. Pat. Nos. 2,474,293, 3,034,892, 3,592,383, 3,311,476, 3,476,563, etc., compounds capable of releasing a development-inhibiting compound upon color forming reaction (the so-called DIR couplers and DIR compounds) (described in, for example, U.S. Pat. Nos. 3,632,345, 3,227,554, 3,379,529, etc.), yellow dye-forming couplers (described in, for example, West German Patent Application (OLS) No. 2,213,461, U.S. Pat. No. 3,510,306, etc.), and magenta dye-forming couplers (described in, for example, U.S. Pat. No. 3,615,506, Japanese Patent Application (OPI) No. 13041/75 and West German Patent Application (OLS) No. 2,418,959) can be used.

The above-described couplers and the like can be used in combinations of two or more in the same layer to obtain desired characteristics for the light-sensitive materials. It is, of course, possible to add the same compound to two or more different layers.

Suitable silver halide emulsions which can be used in the present invention include those containing silver chloride and silver bromide as well as mixed halides of silver such as silver chlorobormide, silver iodobromide, silver chloroiodobromide, etc.

The silver halide grains of these emulsions may have a cubic form, an octahedral form, or may have a mixed crystalline structure.

The silver halide grain size distribution may be narrow or broad, and is not particularly limited. Suitable methods of preparing the silver halide emulsion which can be used include those well known in the art such as the single and double jet process, the controlled double jet process, etc.

Two or more types of silver halide emulsions which have been prepared separately using different processes can be employed. The grain structure of the silver halide may be uniform or different from the surface of the interior, or may be of the so-called "conversion" type as described in British Pat. No. 635,841 and U.S. Pat. No. 3,622,318.

Further, silver halide grains which provide latent images primarily at the surface thereof or in the interior can be employed in the present invention.

The silver halide emulsions used in this invention may be chemically sensitized using well-known chemical sensitizers including sodium thiosulfate, N,N,N'-trimethylthiourea, the complex salts of monovalent gold such as the thiocyanates or the thiosulfates, etc., stannous chloride, hexamethylenetetramine, etc.

The layers of the photographic material can be coated using any known coating method including dip coating, air-knife coating, curtain coating, extrusion coating using a hopper as described in U.S. Pat. No. 2,681,294 and using a simultaneous multilayer coating as set forth in U.S. Pat. Nos. 2,761,791, 3,508,947, 2,941,898, 3,526,528, etc.

Suitable hydrophilic high molecular weight materials which can be present in the photographic coatings of the present invention include gelatin (including alkali processed gelatin and acid processed gelatin), cellulose derivatives, such as carboxymethyl cellulose, hydroxyethyl cellulose, etc., carbohydrate derivatives, such as starch derivatives, synthetic hydrophilic colloid materials, such as poly(vinyl alcohol), poly(N-vinylpyrrolidone), copolymers containing acrylic acid, polyacrylamide and the derivatives or partially hydrolyzed products of the above-described polymers, etc. Of these, the most representative is gelatin and gelatin is most generally used. The gelatin can be partly or completely replaced by a synthetic polymer or a gelatin derivative.

The color photographic materials of the present invention may comprise photographic emulsions spectrally sensitized or supersensitized so as to be sensitive to blue, green or red light using cyanine dyes, such as cyanine, merocyanine, carbocyanine, etc., dyes, alone or as combinations thereof or in combination with styryl dyes. Descriptions of suitable spectral sensitization techniques appear in, for example, U.S. Pat. No. 2,493,748 for the blue region, U.S. Pat. No. 2,688,545 for the green region and U.S. Pat. No. 3,511,664 for the red region.

The photographic emulsion containing the coupler of the present invention can contain known stabilizers or anti-fogging agents (e.g., 4-hydroxy-6-methyl-1,3,3a,7-tetrazaindene, 3-methylbenzothiazole, 1-phenyl-5-mercaptotetrazole, mercury-containing compounds, mercapto compounds, metallic salts, etc.).

A synthetic polymeric material can be mixed with the hydrophilic colloid such as gelatin in the photographic emulsion layer and other layers of the photographic color material of the present invention. A typical example of such a polymeric material is an aqueous latex of vinyl polymers as disclosed in U.S. Pat. No. 2,376,005, etc.

The couplers of the present invention can be used in multilayer color photographic materials of the conventional type (e.g., those described in U.S. Pat. Nos. 3,726,681, 3,516,831, British Pat. Nos. 818,687 and 923,045, etc.), in the processes set forth in Japanese Patent Application (OPI) No. 5179/75, and also in the methods disclosed in German Patent Application (OLS) No. 2,322,165 and U.S. Pat. No. 3,703,375 in which they are used in combination with a DIR compound.

Silver halide photographic materials of the present invention comprise a support and various coatings thereon, such as a silver halide emulsion layer, an intermediate layer, an antihalation layer, a protective layer, a yellow filter layer, a backing layer, a mordanting polymer layer, a layer for preventing stains by the developer, etc. The silver halide emulsion layers for color photography comprise a red sensitive silver halide emulsion layer, a green sensitive silver halide emulsion layer and a blue sensitive silver halide emulsion layer. There is no particular limitation on the layer arrangement thereof, and furthermore, each of these layers can be divided into two or more layers.

From the point of view of obtaining increased stability of color photographic pictures, it is advantageous for the light-sensitive material of the present invention to contain a p-substituted phenol derivative in an emulsion layer or a neighboring layer. Particularly preferred p-substituted phenol derivatives can be selected from among hydroquinone derivatives described in U.S. Pat.

Nos. 2,360,290, 2,418,613, 2,675,314, 2,701,197, 2,704,713, 2,710,801, 2,728,659, 2,732,300, 2,735,765, 2,816,028, etc.; gallic acid derivatives as described in U.S. Pat. Nos. 3,457,097, 3,069,262, and Japanese Patent Publication No. 13496/68; p-alkoxyphenols as described in U.S. Pat. No. 2,735,765 and Japanese Patent Application (OPI) No. 4738/72; and p-oxyphenol derivatives as described in U.S. Pat. Nos. 3,432,300, 3,573,050, 3,574,627 and 3,764,337.

The light-sensitive material used in the invention advantageously contains an ultraviolet light absorbent described in, for example, U.S. Pat. Nos. 3,250,617, 3,253,921, etc., in an emulsion layer or a neighboring layer for stabilizing images.

The silver halide emulsion and other layers can be hardened using any conventionally known methods employing, e.g., aldehyde compounds such as formaldehyde, glutaraldehyde, etc., ketone compounds, such as diacetyl or cyclopentanedione, compounds having a reactive halogen, such as bis(2-chloroethylurea), 2-hydroxy-4,6-dichloro-1,3,5-triazine, and those described in U.S. Pat. Nos. 3,288,775, 2,732,303, 3,125,449 and 1,167,207, compounds having a reactive olefinic group, such as divinyl sulfone, 5-acetyl-1,3-diacryloylhexahydro-1,3,5-triazine, and those set forth in U.S. Pat. Nos. 3,635,718 and 3,232,763, British Pat. No. 994,869, etc., N-methylol compounds, such as N-hydroxymethyl phthalimide and those set forth in U.S. Pat. Nos. 2,732,316 and 2,586,168, etc., isocyanate compounds disclosed in U.S. Pat. No. 3,103,437, aziridine compounds set forth in U.S. Pat. Nos. 3,017,280 and 2,983,611, etc., acid derivatives described in U.S. Pat. Nos. 2,725,294 and 2,725,295, etc., carbodiimide derivatives such as those described in U.S. Pat. No. 3,100,704, etc., epoxy compounds set forth in, for example, U.S. Pat. No. 3,091,537, isoxazoles disclosed in U.S. Pat. Nos. 3,321,313 and 3,543,292, halocarboxyaldehyde compounds including mucochloric acid, dioxane derivatives such as dihydroxydioxane, dichlorodioxane, etc., or inorganic hardening agents such as chrome alum, zirconium sulfate, etc.

Precursors of hardening agents can also be used with examples of such precursors including alkali metal bisulfite/aldehyde adducts, the methylol derivative of hydantoin, primary aliphatic nitro alcohols, etc.

The color photographic light-sensitive material of the present invention can be subjected to conventional and well known processings comprising, after exposure, color development, bleaching and fixing. These processing steps may be combined with other processing steps using a processing agent capable of accomplishing the corresponding functions of the separate steps. A typical example of such a combined processing is a mono-bath process using a blix solution.

Depending on the requirements, the development processing can include additional steps such as prehardening, neutralization, primary development (black-and-white development), image stabilization, washing with water, etc. The processing temperature, which is determined depending on the kind of photographic material as well as by the processing composition, is variable but, in most cases, is not lower than about 18° C.

A particularly useful temperature range is from about 20° to 60° C. The temperature may be varied from one processing step to another in the processing.

A color developer comprises an aqueous alkaline solution with a pH not lower than about 8, and more preferably between 9 and 12, containing a color developing agent the oxidation product of which is capable of reacting with a coupler to form a dye.

Suitable color developing agents which can be used include, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3β-methanesulfamidoethyl-N,N-diethylaniline, and the salts thereof, such as the sulfates, the hydrochlorides, the sulfites, the p-toluenesulfonates, etc. Other color developing agents which can be used are described in U.S. Pat. Nos. 2,592,364 and 2,193,015, Japanese Patent Application (OPI) No. 64933/73, L. F. A. Mason, *Photographic Processing Chemistry*, pp. 226–229, Focal Press, London (1966), etc.

Each of the above-described compounds can be used in conjunction with 3-pyrazolidone derivatives. Further, a number of additives well known in the art may be present in the color developer.

The photographic material of the present invention is subjected to bleaching after color development. This step may be combined with fixing, whereby the processing solution contains a fixing agent in addition to a bleaching agent.

Suitable bleaching agents include ferricyanide salts, bichromate salts, water-soluble cobalt (III) salts, water-soluble copper (II) salts, water-soluble quinones, nitrosophenol, polyvalent metal compounds containing Fe (III), Co (III), Cu (II), with complex salts of such metals with organic acids, such as, for example, ethylenediaminetetraacetic acid, nitrilotriacetic acid, imidoacetic acid, N-hydroxyethylethylenediaminetriacetic acid and other aminopolycarboxylic acid, malonic acid, tartaric acid, malic acid, diglycolic acid, dithioglycolic acid and 2,6-dipicolic acid copper complex salt, etc., being particularly preferred, peracids, such as alkyl peracids, persulfates, permanganates, hydrogen peroxide, etc., hypochlorites, etc.

Other additives, such as bleach accelerating agents as disclosed in U.S. Pat. Nos. 3,042,520 and 3,241,966, Japanese Patent Publication Nos. 8506/70 and 8836/70, etc., can be further added to the bleaching solution.

It has been found that the couplers in accordance with the invention can be used even for silver halide photographic materials of the low silver content type in which the amount of silver halide in the emulsion is from several tenths to one hundred times smaller than that of the ordinary photographic material. Using such a photosensitive material, color images of sufficiently high density can be obtained using the color intensification process in which a peroxide or a cobalt complex salt is employed (for example, as disclosed in German Patent Application (OLS) No. 2,357,694, U.S. Pat. Nos. 3,674,490 and 3,761,265, German Patent Application (OLS) Nos. 2,044,833, 2,056,359, 2,056,360 and 2,226,770, Japanese Patent Application (OPI) Nos. 9728/73 and 9729/73, etc.).

The invention is described in more detail by reference to the following examples which, however, are not intended to limit the present invention in any way.

EXAMPLE 1

10 g of the foregoing Coupler (2), i.e., 1-hydroxy-4-[β-hydroxy(γ-ethylsulfinyl)propyloxy]-N-n-hexadecyl- 2-naphthamide was added to a mixture of 10 ml of di-n-butyl phthalate and 20 ml of ethyl acetate and dissolved by heating to 50° C. The resulting solution was added to 100 ml of an aqueous solution containing 10 g of gelatin and 0.5 g of sodium p-dodecylbenzenesulfonate, and subjected to vigorous mechanical stirring for 20 minutes using a high speed agitator to thereby finely emulsify and disperse the coupler together with the solvent. (The resulting emulsion is referred to as Emulsion Dispersion (I)).

63.2 g of this fine Emulsion Dispersion (I) was added to 100 g of a photographic emulsion containing 0.03 mol of silver chlorobromide (AgBr: 50 mol%) and 8 g of gelatin, and 12 ml of a 2% aqueous solution of 2-hydroxy-4,6-dichloro-s-triazine sodium salt was added thereto as a hardener. Then, the pH was adjusted to 6.5, and the resulting emulsion was coated on a cellulose triacetate film support in a coated silver amount of $8.5\times10^{-3}$ mol/m$^2$ to prepare a photographic light-sensitive material, which was called Sample I. The coupler content in Sample I was $2.16\times10^{-3}$ mol/m$^2$.

Then, in a manner analogous to the above-described process for Emulsion Dispersion (I) except using 10 g of the foregoing Couplers (3) and (5), Emulsion Dispersions (II) and (III), respectively, were prepared. Photographic light-sensitive materials were prepared in the same manner as with Sample I using the same photographic emulsion except for adding 64.9 g of Emulsion Dispersion (II) and 66.5 g of Emulsion Dispersion (III), respectively. The resulting two samples were referred to as Samples II and III, respectively.

As comparative samples, photographic light-sensitive materials were prepared in the same manner as with Sample I except for using 10 g of 1-hydroxy-4-propyloxy-N-n-hexadecyl-2-naphthamide (Coupler a) and 10 g of 1-hydroxy-4-butoxy-N-n-hexadecyl-2-naphthamide (Coupler b), respectively, and adding 52.9 g and 54.1 g of the emulsion dispersion, respectively. The resulting comparative samples were referred to as Samples A and B.

The coupler contents in these Samples II, III, A and B were $2.15\times10^{-3}$ mol/m$^2$, $2.14\times10^{-3}$ mol/m$^2$, $2.15\times10^{-3}$ mol/m$^2$, and $2.13\times10^{-3}$ mol/m$^2$, respectively.

These photographic light-sensitive materials were subjected to stepwise exposure for sensitometry, then to the following processing steps, in the order described.

| | | Temperature (°C.) | Time (minutes) |
|---|---|---|---|
| 1. | Color Development | 24 | 8 |
| 2. | Washing with Water | " | 1 |
| 3. | First Fixing | " | 4 |
| 4. | Washing with Water | " | 3 |
| 5. | Bleaching | " | 3 |
| 6. | Washing with Water | " | 3 |
| 7. | Second Fixing | " | 4 |
| 8. | Washing with Water | " | 10 |

The composition of the color developer used in the above-described color development processing was as follows.

| Color Developer | |
|---|---|
| Sodium Sulfite (anhydrous) | 3.0 g |
| 4-Amino-3-methyl-N,N-diethylaniline Hydrochloride | 2.5 g |
| Sodium Carbonate (monohydrate) | 47.0 g |

-continued

| Color Developer | |
|---|---|
| Potassium Bromide | 2.0 g |
| Water to make | 1,000 ml |

The fixing solution and the bleaching solution had the following compositions, respectively.

| Fixing Solution (first and second fixing solutions) | |
|---|---|
| Sodium Thiosulfate | 150 g |
| Sodium Sulfite | 15 g |
| Glacial Acetic Acid (28% aq. soln.) | 48 ml |
| Boric Acid | 7.5 g |
| Water to make | 1,000 ml |
| **Bleaching Solution** | |
| Potassium Bromide | 20 g |
| Potassium Ferricyanide | 100 g |
| Glacial Acetic Acid | 20 ml |
| Sodium Acetate | 40 g |
| Water to make | 1,000 ml |

After the above-described processing steps, the optical densities of these Samples I, II, III, A and B with respect to red light were measured to obtain the results tabulated in Table 1 below.

TABLE 1

| Film Sample | Coupler | Amount of Coupler (mol/m$^2$) | Fog | Sensitivity* (relative value) | Gamma | Maximum Density |
|---|---|---|---|---|---|---|
| I | (2) | $2.16\times10^{-3}$ | 0.05 | 100 | 3.35 | 3.47 |
| II | (3) | $2.15\times10^{-3}$ | 0.05 | 123 | 3.73 | 3.70 |
| III | (5) | $2.14\times10^{-3}$ | 0.06 | 140 | 3.95 | 3.87 |
| A | (a) | $2.15\times10^{-3}$ | 0.05 | 72 | 1.80 | 2.40 |
| B | (b) | $2.13\times10^{-3}$ | 0.04 | 65 | 1.67 | 2.25 |

*Relative values of the reciprocals of exposure amounts necessary for obtaining a density of fog + 0.1.

Separately, Samples I, II, III, A and B were processed by changing the time of the color development, and the maximum densities for red light were measured to obtain the results shown in Table 2 below.

TABLE 2

| Film Sample | Coupler | Developing Time (minutes) 4 | 8 | 15 |
|---|---|---|---|---|
| I | This Invention (2) | 3.39 | 3.47 | 3.50 |
| II | This Invention (3) | 3.64 | 3.70 | 3.72 |
| III | This Invention (5) | 3.83 | 3.87 | 3.87 |
| A | Comparison (a) | 2.12 | 2.40 | 2.62 |
| B | Comparison (b) | 1.94 | 2.25 | 2.40 |

These results show that as compared with Coupler (a) wherein the coupling site is substituted by a propyloxy group and Coupler (b) wherein the active site is substituted by a butoxy group used in the comparative samples, the couplers of this invention provide a high sensitivity, high gradation of density, and high color density, and they provide sufficient color formation in a short time so that the processing time can be shortened. In order to more clearly show the improved coupling reactivity, the following experiments were conducted.

Samples obtained in the same manner as with Sample I using, respectively, mixtures prepared by mixing the foregoing Couplers (2), (3), (5) of the present invention, Coupler (a) and Coupler (b) with a yellow color-forming Coupler (c), α-(4-methoxybenzoyl)-2-chloro-5-[α-(2',4'-di-tert-amylphenoxy)butyramido]acetanilide, in a molar ratio of 1:2 were subjected to the action of 4-amino-3-methyl-N,N-diethylaniline as a color developing agent to competitively form color. The relative reaction rate constants of the coupling reaction of the couplers of the present invention based on yellow color-forming Coupler (c) were calculated by analyzing the ratio of the amount of the yellow dye to that of the cyan dye formed.

The coupling reactivity of the coupler can be determined as a relative value by adding the combination of two Couplers M and N providing dyes distinctly discriminatable from each other to an emulsion, and measuring the amounts of each of the dyes obtained by color-developing the emulsion.

Suppose that Coupler M provides a maximum density of $(DM)_{max}$ and a medium density of DM, and that Coupler N provides a maximum density of $(DN)_{max}$ and a medium density of DN, respectively. Then, the reactivity ratio of the two couplers, RM/RN, can be represented by the following formula:

$$\frac{RM}{RN} = \frac{\log\left(1 - \frac{DM}{(DM)_{max}}\right)}{\log\left(1 - \frac{DN}{(DN)_{max}}\right)}$$

That is, the coupling reactivity ratio, RM/RN, can be determined from the slope of the straight line obtained by plotting several sets of DM and DN, obtained by stepwise exposing the emulsion containing the mixture of couplers and development processing such, on two rectangular coordinate axes as $$\log\left(1 - \frac{D}{D_{max}}\right)$$

As a result, it was found that relative reaction rate constants of couplers of the present invention Couplers (2), (3) and (5) were 2.9, 3.5 and 3.9, respectively, whereas that of conventionally known Coupler (a) substituted by a propyloxy group in an active site was 0.9 and that of butoxy substituted Coupler (b) was 0.8. Thus, this clearly demonstrates that the couplers of the present invention have an improved reactivity and are excellent couplers.

EXAMPLE 2

10 g of the foregoing Coupler (15), i.e., 1-hydroxy-4-[β,γ-di(hydroxyethylsulfinyl)propyloxy]-N-[γ-(2,4-di-tert-amylphenoxy)propyl]-2-naphthamide was added to a mixture of 10 ml of tricresyl phosphate, 20 ml of ethyl acetate, and 0.5 g of sodium di(2-ethylhexyl)-α-sulfosuccinate and, after heating to 50° C. to dissolve, the mixture was added to 100 ml of an aqueous solution containing 10 g of gelatin, then finely emulsified and dispersed using a homogenizer to obtain an emulsion dispersion which was referred to as Emulsion Dispersion (IV).

49.9 g of this fine Emulsion Dispersion (IV) was added to 100 g of a silver bromoiodide emulsion (gelatin content: 6 g) containing 7 mol% of iodide and $3.5\times10^{-2}$ mol of silver. Then, to the resulting mixture were added 5 ml of a 2% methanol solution of 6-methyl-4-hydroxy-1,3,3a,7-tetraazaindene and 6.5 ml of a 2% aqueous solution of 2-hydroxy-4,6-dichloro-s-triazine sodium salt (as a hardener) and, finally, the pH was adjusted to 6.5. The resulting mixture was coated on a cellulose triacetate support in a coated coupler amount of $2.06\times10^{-3}$ mol/m$^2$ to obtain Sample IV.

Then, the foregoing Coupler (12), comparative Couplers (d), (e), (f), (g) and (h) having the following formulae (d)

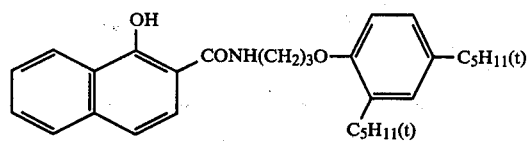

(e)

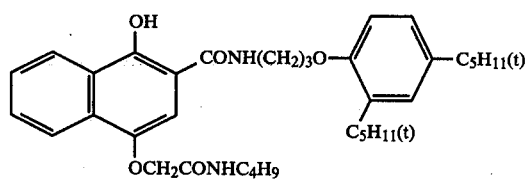

(f)

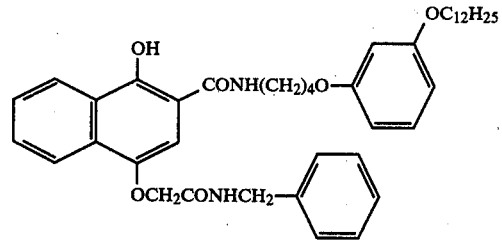

(g)

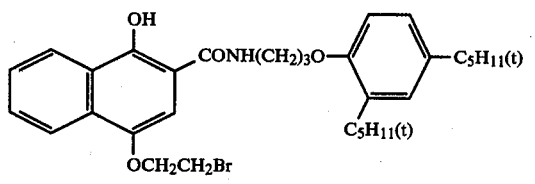

(h)

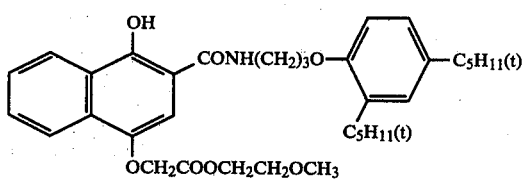

were used and, in the same manner as with Emulsion Dispersion (IV), Emulsion Dispersions (V), (D), (E), (F), (G) and (H) corresponding to Couplers (12), (d), (e), (f), (g) and (h), respectively, were prepared. Then, Samples V, D, E, F, G and H containing 51.8 g of Emulsion Dispersion (V) and 100 g of the same silver bromoiodide emulsion as used in Sample IV, 32.4 g of Emulsion Dispersion (D) and 200 g of the same silver bromoiodide emulsion as used in Sample IV, 41.3 g of Emulsion Dispersion (E) and 100 g of the same silver bromoiodide emulsion as used in Sample IV, 50.0 g of Emulsion Dispersion (F) and 100 g of the same silver bromoiodide emulsion as used in Sample IV, 41.9 g of Emulsion Dispersion (G) and 100 g of the same silver bromoiodide emulsion as used in Sample IV, and 41.8 g of Emulsion Dispersion (H) and 100 g of the same silver bromoiodide emulsion as used in Sample IV, respectively, were prepared.

The coupler contents in these six samples are shown in Table 3 below.

These seven samples were stepwise exposed and then subjected to the following processing steps.

| Processing Step | Temperature (°C.) | Time |
|---|---|---|
| 1. Color Development | 38 | 3 min 15 sec |
| 2. Bleaching | " | 6 min 30 sec |
| 3. Washing with Water | " | 2 min |
| 4. Fixing | " | 4 min |
| 5. Washing | " | 4 min |
| 6. Stabilizing Bath | " | 1 min |

The processing solutions used had the following compositions.

| | |
|---|---|
| Color Developer Solution | |
| 4-Amino-N-ethyl-N-(β-methanesulfonamidoethyl)aniline Monosulfate | 5 g |
| Sodium Sulfite | 5 g |
| Hydroxylamine Sulfate | 2 g |
| Potassium Carbonate | 30 g |
| Potassium Hydrogen Carbonate | 1.2 g |
| Potassium Bromide | 1.2 g |
| Sodium Chloride | 0.2 g |
| Trisodium Nitrilotriacetate | 1.2 g |
| Adjust pH to 10.1 | |
| Water to make | 1,000 ml |
| Bleaching Solution | |
| Iron (III) Ammonium Ethylenediaminetetraacetate | 100 g |
| Disodium Ethylenediaminetetraacetate | 10 g |
| Potassium Bromide | 150 g |
| Glacial Acetic Acid | 10 g |
| Aqueous Ammonia to adjust pH to 6.0 | |
| Water to make | 1,000 ml |
| Fixing Solution | |
| Ammonium Thiosulfate | 150 g |
| Sodium Sulfite | 10 g |
| Sodium Hydrogen Sulfite | 2.5 g |
| Adjust pH to 6.0 | |
| Water to make | 1,000 ml |
| Stabilizing Bath | |
| Formaldehyde (37% aq. soln.) | 5 ml |
| Fuji Driwel | 3 ml |
| Water to make | 1,000 ml |

After the above-described processings, the optical densities of these Samples IV, V, D, E, F, G and H for red light were measured and the results shown in Table 3 below were obtained.

TABLE 3

| Film Sample | Coupler | Amount of Coupler (mol/m²) | Fog | Sensitivity* (relative values) | Gamma | Maximum Density |
|---|---|---|---|---|---|---|
| IV | This Invention (15) | $2.06 \times 10^{-3}$ | 0.06 | 97 | 2.80 | 3.37 |
| V | This Invention (12) | $2.05 \times 10^{-3}$ | 0.06 | 100 | 2.82 | 3.40 |
| D | Comparison (d) | $2.05 \times 10^{-3}$ | 0.06 | 63 | 1.55 | 2.35 |
| E | Comparison (e) | $2.05 \times 10^{-3}$ | 0.06 | 66 | 1.81 | 2.45 |
| F | Comparison (f) | $2.06 \times 10^{-3}$ | 0.07 | 73 | 1.93 | 2.42 |
| G | Comparison (g) | $2.07 \times 10^{-3}$ | 0.06 | 69 | 1.85 | 2.31 |
| H | Comparison (h) | $2.04 \times 10^{-3}$ | 0.06 | 81 | 2.12 | 2.65 |

*Relative values of the reciprocals of exposure amounts necessary for obtaining a density of fog + 0.1.

From the results shown in Table 3 above, it is apparent that cyan couplers having a coupling-off group represented by the formula (I) according to this invention have superior properties with respect to sensitivity, gamma, and maximum density in comparison with known couplers.

EXAMPLE 3

45.0 g of the foregoing Coupler (29), i.e., 2-chloro-3-methyl-4-[β-hydroxy-γ-(β'-hydroxyethylsulfinyl)-propyloxy]-6-[α-(2,4-di-tert-amylphenoxy)-butyramido]phenol, 40 ml of di-n-butyl phthalate, 80 ml of ethyl acetate, and 2.0 g of sodium di(2-ethylhexyl)-α-sulfosuccinate were mixed and heated to 50° C. to dissolve. The resulting solution was added to 400 ml of an aqueous solution containing 40 g of gelatin, and the thus-obtained emulsion was further finely emulsified and dispersed using a homogenizer.

An emulsion to be used was a red sensitive silver chlorobromide emulsion containing 50 mol% bromide, 0.3 mol of silver, and 70 g of gelatin, then adding thereto 50 ml of a 1% methanol solution of 6-methyl-4-hydroxy-1,3,3a,7-tetrazaindene.

To this emulsion was added the entire amount of the above-described emulsion dispersion, and 30 ml of a 3% acetone solution of triethylenephosphamide was added thereto as a hardener. Finally, the pH was adjusted to 6.5 to prepare a red sensitive silver halide emulsion.

On a support of baryta paper resin-treated on both sides with polyethylene were coated, as a first layer, a blue sensitive silver halide emulsion-containing α-(5,5-dimethyl-2,4-dioxooxazolidin-3-yl)-α-pivaloyl-2-chloro-5-[α-(2',4'-di-tert-amylphenoxy)-butyramido]acetanilide in a dry thickness of 4.0μ and, as a second layer, a gelatin solution in a dry thickness of 1.0μ and, as a third layer, a green sensitive silver halide emulsion-containing 1-(2,4,6-trichlorophenyl)-3-[(2-chloro-5-n-tetradecanamido)anilino]-5-pyrazolone in a dry thickness of 2.5μ. As a fourth layer, a gelatin solution containing 2-(2'-benzotriazolyl)-4,6-dibutylphenol as an ultraviolet ray absorbent was coated thereon in a dry thickness of 2.5μ. As a fifth layer, the above-described red sensitive silver halide emulsion was coated in a dry thickness of 3.5μ. Further, as an uppermost layer, a gelatin solution was coated thereon in a dry thickness of 0.5μ to prepare a color photographic paper.

A color negative image was optically printed on this color photographic paper followed by subjecting the paper to the following processing steps.

| Processing Step | Temperature (°C.) | Time |
|---|---|---|
| 1. Color Development | 33 | 3 min 30 sec |
| 2. Bleach-Fixing | 33 | 1 min 30 sec |
| 3. Washing with Water | 25 to 30 | 2 min 30 sec |

Each of the processing solution used had the following composition.

| | |
|---|---|
| Color Developer Solution | |
| Benzyl Alcohol | 15 ml |
| Diethylene Glycol | 8 ml |
| Ethylenediaminetetraacetic Acid | 5 g |
| Sodium Sulfite | 2 g |
| Anhydrous Potassium Carbonate | 30 g |
| Hydroxylamine Sulfate | 3 g |
| Potassium Bromide | 0.6 g |
| 4-Amino-N-ethyl-N-(β-methanesulfonamido-ethyl)-m-toluidine Sesquisulfate Monohydrate | 5 g |
| Adjust pH to 10.20 | |
| Water to make | 1 l |
| Bleach-Fixing Solution | |
| Ethylenediaminetetraacetic Acid | 2 g |
| Ferric Salt of Ethylenediaminetetra-acetate | 40 g |
| Sodium Sulfite | 5 g |
| Ammonium Thiosulfate | 70 g |
| Water to make | 1 l |

The thus-obtained color print had excellent color-reproducing ability with distinct colors. The cyan dye image had an absorption maximum at 673 mμ.

When this color print was irradiated for 20 days under conditions of 30,000 luxes in illuminance using a white fluorescent lamp, a density reduction of 0.03 was observed in the area where the initial reflection density of the cyan dye image was 1.0. When it was left for 10 days under high temperature and high humidity conditions of 60° C. and 75% in relative humidity, a density reduction of 0.05 was observed in the area where the initial reflection density was 1.0. Thus, good color image stability was observed.

Also, when one unexposed coated sample was left for 3 days under conditions of 40° C. and 80% RH and the other for the same time under conditions of 25° C. and 60% RH and, after sensitometric stepwise exposure, the two samples were simultaneously subjected to the above-described processing steps, no changes were observed in photographic characteristics such as maximum density, fog, gamma, etc., in spite of the sample being subjected to such severe conditions. Thus, the light-sensitive material was shown to be stable.

EXAMPLE 4

10 g of the foregoing Coupler (35), i.e., N-n-hexadecyl-N-cyanoethyl-1-hydroxy-4-(β,γ-diethylsulfinylpropyloxy)-2-naphthamide, 10 ml of tris-n-hexyl phosphate, and 20 ml of ethyl acetate were heated to 50° C. to dissolve, and the resulting solution was added to 100 ml of an aqueous solution containing 0.5 g of sodium p-dodecylbenzenesulfonate and 10 g of gelatin, and stirred followed by vigorous mechanical stirring to thereby emulsify and disperse the coupler together with the solvent.

The entire amount of this emulsion dispersion was added to 186 g of a reversal silver bromoiodide emulsion (containing $8.37\times10^{-2}$ mol of Ag and 13.0 g of gelatin) containing 3 mol% of iodide, and 12 ml of a 4% aqueous solution of 2-hydroxy-4,6-dichloro-s-triazine sodium salt was added thereto as a hardener. Finally, the pH was adjusted to 7.0, and the thus-obtained emulsion was coated on a polyethylene terephthalate film support in a coated silver amount of 0.88 g/m$^2$.

This sample was sensitometrically stepwise exposed, and subjected to the following processing steps.

| Processing Step | Temperature (°C.) | Time (minutes) |
|---|---|---|
| 1. First Development | 38 | 3 |
| 2. Washing with Water | " | 1 |
| 3. Reversal | " | 2 |
| 4. Color Development | " | 6 |
| 5. Stopping | " | 2 |
| 6. Bleaching | " | 6 |
| 7. Fixing | " | 4 |
| 8. Washing with Water | " | 4 |
| 9. Stabilizing | " | 1 |
| 10. Drying | | |

Each of the processing solutions used had the following compositions.

| | |
|---|---|
| First Developer Solution | |
| Water | 800 ml |
| Sodium Tetrapolyphosphate | 2.0 g |
| Sodium Bisulfite | 8.0 g |
| Sodium Sulfite | 37.0 g |
| 1-Phenyl-3-pyrazolidone | 0.35 g |
| Hydroquinone | 5.5 g |
| Sodium Carbonate Monohydrate | 28.0 g |
| Potassium Bromide | 1.5 g |
| Potassium Iodide | 13.0 mg |
| Sodium Thiocyanate | 1.4 g |
| Water to make | 1 l |
| Reversal Solution | |
| Water | 800 ml |
| Hexasodium Nitrilo-N,N,N-trimethylene Phosphonic Acid | 3.0 g |
| Stannous Chloride (dihydrate) | 1.0 g |
| Sodium Hydroxide | 8.0 g |
| Glacial Acetic Acid | 15.0 ml |
| Water to make | 1 l |
| Color Developer Solution | |
| Water | 800 ml |
| Sodium Tetrapolyphosphate | 2.0 g |
| Benzyl Alcohol | 5.0 ml |
| Sodium Sulfite | 7.5 g |
| Trisodium Phosphate (12 hydrate) | 36.0 g |
| Potassium Bromide | 1.0 g |
| Potassium Iodide | 90.0 mg |
| Sodium Hydroxide | 3.0 g |
| Citrazinic Acid | 1.5 g |
| 4-Amino-3-methyl-N-ethyl-N-(β-hydroxyethyl)aniline Sesquisulfate Monohydrate | 11.0 g |
| Ethylenediamine | 3.0 g |
| Water to make | 1.0 l |
| Stopping Solution | |
| Water | 800 ml |
| Glacial Acetic Acid | 5.0 ml |
| Sodium Hydroxide | 3.0 g |
| Dimethylaminoethaneisothiourea Dihydrochloride | 1.0 g |
| Water to make | 1 l |
| Bleaching Solution | |
| Water | 800 ml |
| Sodium Ethylenediaminetetraacetate Dihydrate | 2.0 g |
| Ammonium Iron (III) Ethylenediamine-tetraacetate (dihydrate) | 120.0 g |
| Potassium Bromide | 100.0 g |
| Water to make | 1 l |
| Fixing Solution | |
| Water | 800 ml |
| Ammonium Thiosulfate | 80.0 g |

-continued

| | |
|---|---|
| Sodium Sulfite | 5.0 g |
| Sodium Bisulfite | 5.0 g |
| Water to make | 1 l |
| Stabilizing Bath | |
| Water | 800 ml |
| Formaldehyde (37% aq. soln.) | 5.0 ml |
| Fuji Driwel | 5.0 ml |
| Water to make | 1.0 l |

The thus-obtained color reversal image had an absorption maximum at 687 mμ, and showed good color formation.

Further, the same sample was left for 3 days under conditions of 40° C. and 75% RH, sensitometrically stepwise exposed, and subjected to the above-described processings for comparison. No change in photographic characteristics such as $D_{max}$, fog, gamma, sensitivity, etc., were observed. Thus, the coupler was shown to have excellent stability.

EXAMPLE 5

A silver bromoiodide emulsion containing 4 mol% of iodide was coated on a film in a coated silver amount of 120 μg/cm$^2$ and in a thickness of 4.0μ, and stoichiometrically stepwise exposed followed by development processing at 27° C. for 4 minutes using the following color developer. Subsequent processing steps of washing, bleaching, washing, fixing, and washing were conducted as described in Example 1 to obtain a cyan color image. The processing solutions had the following compositions.

| Color Developer | |
|---|---|
| Sodium Sulfite | 5 g |
| 4-Amino-3-methyl-N,N-diethylaniline Hydrochloride | 0.6 g |
| Sodium Carbonate (monohydrate) | 15 g |
| Potassium Bromide | 0.5 g |
| Potassium Iodide (0.1% aq. soln.) | 5 ml |
| Coupler (31) (2-acetamido-6-chloro-4-[β-hydroxy-(γ-carboxymethylsulfinyl)propyloxy]-5-methylphenol) | 1.3 g |
| Methanol | 20 ml |
| Sodium Hydroxide | 2 g |
| Water to make | 1,000 ml |

This image was a distinct cyan color image having an absorption maximum at 672 mμ.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material which comprises a support having thereon at least one silver halide emulsion layer and said photographic material containing a colorless photographic cyan color-forming coupler having, in a position for coupling with the oxidation product of an aromatic primary amine developing agent, a coupling-off group represented by the following general formula (I):

$$—O—R—SO—R_1 \quad (I)$$

wherein R represents a substituted straight or branched chain alkylene group or a substituted straight or branched chain alkenylene group; $R_1$ represents a substituted or unsubstituted straight or branched chain alkyl group, a straight or branched chain alkenyl group, a straight or branched chain aralkyl group, a straight or branched chain aralkenyl group, a cycloalkyl group, an aryl group or a heterocyclic group; and R and $R_1$ may be bonded to each other directly or through a connecting group to form a ring.

2. The color photographic light-sensitive material as claimed in claim 1, wherein said cyan color-forming coupler is represented by the following general formula (IA):

$$A—O—R—SO—R_1)_n \quad (IA)$$

wherein R and $R_1$ are defined as in claim 1; A represents a cyan color-forming coupler residue containing a phenolic or naphtholic nucleus; and n represents a positive integer.

3. The color photographic light-sensitive material as claimed in claim 2, wherein R represents a substituted alkylene group having 1 to 18 carbon atoms or a substituted alkenylene group having 2 to 18 carbon atoms.

4. The color photographic light-sensitive material as claimed in claim 3, wherein said substituent for said alkylene group or said alkenylene group is an aryl group, a nitro group, a hydroxy group, a cyan group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group, an acyl group, a sulfonyl group, a heterocyclic group, an amino group or a sulfinyl group represented by the formula —$SOR_1$, wherein $R_1$ is defined as in claim 1.

5. The color photographic light-sensitive material as claimed in claim 2, wherein $R_1$ represents an alkyl group having 1 to 18 carbon atoms, an alkenyl group having 2 to 18 carbon atoms, an aralkyl group having from 7 to 18 carbon atoms, an aralkenyl group having from 8 to 18 carbon atoms, a cycloalkyl group, an aryl group having from 6 to 12 carbon atoms, or a 5-membered or 6-membered heterocyclic group.

6. The color photographic light-sensitive material as claimed in claim 5, wherein said alkyl group, alkenyl group, aralkyl group, aralkenyl group, cycloalkyl group, aryl group and heterocyclic group for $R_1$ may be substituted with a substituent selected from the group consisting of a halogen atom, a cyano group, a hydroxy group, an alkoxy group, an aryloxy group, an acyloxy group, an acylamino group, a sulfonamido group, a sulfamoyl group, a sulfonyl group, a carboxy group, a sulfo group, a nitro group, an arylthio group, an alkylthio group, a carbamoyl group, an alkoxycarbonyl group, a sulfinyl group and a heterocyclic group.

7. The color photographic light-sensitive material as claimed in claim 5, wherein $R_1$ represents a substituted or unsubstituted alkyl group, alkenyl group, cycloalkyl group or 5-membered or 6-membered heterocyclic group.

8. The color photographic light-sensitive material as claimed in claim 2, wherein R represents a straight or branched chain alkylene group having 1 to 4 carbon atoms substituted with an alkylsulfinyl group represented by the formula —SO—$R_{11}$, wherein $R_{11}$ has the same meaning as defined for $R_1$, or a hydroxy group.

9. The color photographic light-sensitive material as claimed in claim 2, wherein said —SO—$R_1$ group is present at the α-, β- or γ-position with respect to the alkoxy group represented by —OR.

10. The color photographic light-sensitive material as claimed in claim 2, wherein n is 1 or 2.

11. The color photographic light-sensitive material as claimed in claim 2, wherein A represents a cyan color-forming coupler residue containing a phenolic nucleus.

12. The color photographic light-sensitive material as claimed in claim 2, wherein A represents a cyan color-forming coupler residue containing a naphtholic nucleus.

13. The color photographic light-sensitive material as claimed in claim 1, wherein said coupler is represented by the formula (IIA)

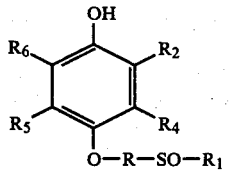

(IIA)

wherein R and $R_1$ each has the same meaning as defined in claim 1, $R_2$ represents a hydrogen atom, an aliphatic group containing up to 30 carbon atoms, an alkoxy group containing up to 30 carbon atoms, an aryloxy group, or a group represented by the following formulae

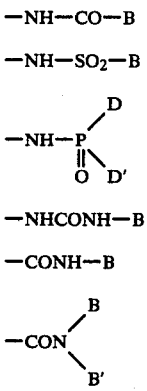

(III) (IV) (V) (VI) (VII) (VIII)

wherein B and B', both of which may be substituted, may be the same or different, and each represents an aliphatic group containing from 1 to 32 carbon atoms or an aryl group, D and D' each represents a B group or —OB, —NHB, and $—NB_2$; $R_4$, $R_5$ and $R_6$ each represents a hydrogen atom, a halogen atom, an alkyl group, an aryl group, an alkoxy group, an alkylthio group, a heterocyclic group, an amino group, a carbonamido group, a sulfonamido group, a sulfamoyl group or a carbamyl group.

14. The color photographic light-sensitive material as claimed in claim 1, wherein said coupler is represented by the formula (IIB)

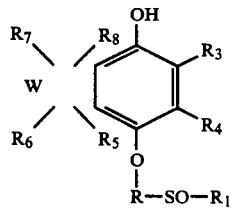

(IIB)

wherein R and $R_1$ each has the same meaning as defined in claim 1; $R_3$ represents a hydrogen atom, an aliphatic group containing up to 30 carbon atoms, or a group represented by the following formulae

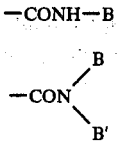

(VII) (VIII)

wherein B and B', both of which may be substituted, may be the same or different, and each represents an aliphatic group containing from 1 to 32 carbon atoms, or an aryl group; and $R_4$, $R_5$, $R_6$, $R_7$ and $R_8$ each represents a hydrogen atom, a halogen atom, an alkyl group, an aryl group, an alkoxy group, an alkylthio group, a heterocyclic group, an amino group, a carbonamido group, a sulfonamido group, a sulfamoyl group, or a carbamyl group; and W represents the non-metallic atoms necessary to form a 5- or 6-membered carbocyclic or heterocyclic ring.

15. The color photographic light-sensitive material as claimed in claim 13 or 14, wherein said substituent for said aliphatic group or aryl group for B and B' is a halogen atom, a nitro group, a cyano group, a hydroxy group, a carboxy group, an amino group, an alkyl group, an aryl group, an alkoxycarbonyl group, an acyloxycarbonyl group, an amido group, an imido group, a carbamoyl group, a sulfamoyl group, an alkoxy group or an aryloxy group.

16. The color photographic light-sensitive material as claimed in claim 13 or 14, wherein said coupler is diffusion resistant and contains a hydrophobic ballast group having from 8 to 30 carbon atoms in at least one of the $R_1$ to $R_8$ substituent positions.

17. The color photographic light-sensitive material as claimed in claim 1, 2, 13 or 14, wherein said coupler is present in a silver halide emulsion layer.

18. The color photographic light-sensitive material as claimed in claim 16, wherein said coupler is present in a silver halide emulsion layer.

19. The color photographic light-sensitive material as claimed in claim 17, wherein said silver halide emulsion layer is a red sensitive silver halide emulsion layer.

20. The color photographic light-sensitive material as claimed in claim 19, wherein said photographic light-sensitive material further comprising at least one blue sensitive silver halide emulsion layer containing a yellow color forming coupler and at least one green sensitive silver halide emulsion layer containing a magenta color forming coupler.

21. The color photographic light-sensitive material as claimed in claim 18, wherein said silver halide emulsion layer is a red sensitive silver halide emulsion layer.

22. The color photographic light-sensitive material as claimed in claim 21, wherein said photographic light-sensitive material further comprising at least one blue sensitive silver halide emulsion layer containing a yellow color forming coupler and at least one green sensitive silver halide emulsion layer containing a magenta color forming coupler.

23. The color photographic light-sensitive material as claimed in claim 1, wherein said coupler is present in an amount of from about 1 to 1,500 g per mol of silver halide.

24. The color photographic light-sensitive material as claimed in claim 1, wherein said coupler is present in a layer containing a p-substituted phenol derivative or in a layer adjacent a layer containing a p-substituted phenol derivative.

25. The color photographic light-sensitive material as claimed in claim 14, wherein W represents the atoms necessary to form a benzene ring.

26. A method of forming color images which comprises developing a photographic light-sensitive material comprising a support having thereon at least one silver halide emulsion layer with a developing solution containing an aromatic primary amine developing agent in the presence of a colorless photographic cyan color forming coupler having, in a position for coupling with the oxidation product of the aromatic primary amine developing agent, a coupling-off group represented by the following general formula (I):

$$-O-R-SO-R_1$$

wherein R represents a substituted straight or branched chain alkylene group or a substituted straight or branched chain alkenylene group; $R_1$ represents a substituted or unsubstituted straight or branched chain alkyl group, a straight or branched chain alkenyl group, a straight or branched chain aralkyl group, a straight or branched chain aralkenyl group, a cycloalkyl group, an aryl group or a heterocyclic group, and R and $R_1$ may be bonded to each other directly or through a connecting group to form a ring.

27. The method of forming color images as claimed in claim 26, wherein said coupler is present in a silver halide emulsion layer.

28. The method of forming color images as claimed in claim 26, wherein said coupler is present in a developing solution.

* * * * *